United States Patent [19]

Ciani et al.

[11] 4,180,434

[45] Dec. 25, 1979

[54] MICA PAPER CONTAINING CELLULOSE

[75] Inventors: Jean A. Ciani, Valdoie, France; Ernst Diehl; Berno Haberthür, both of Breitenbach, Switzerland

[73] Assignee: Schweizerische Isola-Werke, Breitenbach, Switzerland

[21] Appl. No.: 862,272

[22] Filed: Dec. 15, 1977

Related U.S. Application Data

[63] Continuation-in-part of Ser. No. 652,781, Jan. 27, 1976, abandoned.

[51] Int. Cl.[2] ..... D21H 3/66

[52] U.S. Cl. ..... 162/138; 162/181 C

[58] Field of Search ..... 162/181 C, 138, 145, 162/152, 181 R; 174/137 B

[56] References Cited

U.S. PATENT DOCUMENTS

| | | | |
|---|---|---|---|
| 852,918 | 5/1906 | White | 162/181 C |
| 1,868,566 | 7/1932 | Crossman | 162/181 C |
| 2,614,055 | 10/1952 | Senarclens | 162/152 |
| 3,001,571 | 9/1961 | Hatch | 162/152 |

FOREIGN PATENT DOCUMENTS

| | | | |
|---|---|---|---|
| 46-2762 | 1/1971 | Japan | 162/138 |

*Primary Examiner*—S. Leon Bashore
*Assistant Examiner*—Peter Chin
*Attorney, Agent, or Firm*—Schiller and Pandiscio

[57] ABSTRACT

A novel electrically insulating mica paper containing cellulose, but no binding agent and having a tensile strength and a porosity higher than those of pure mica paper is disclosed. The tensile strength is sufficiently high for the mica paper to be processed without backing. The novel mica paper contains mica pulp consisting of platelets of natural mica and 10 to 50% by weight, preferably 20 to 30% by weight, of cellulose fibres which preferably have a freeness of 20 to 60 on the Schopper-Riegler scale. It can be produced by adding cellulose fibres to mica pulp produced without using chemicals other than water and processing the mixed pulp by conventional methods to a paper, without using a binding agent, temperatures higher than 100° C. or pressure.

4 Claims, 2 Drawing Figures

MICA PAPER CONTAINING CELLULOSE

Figure 1:
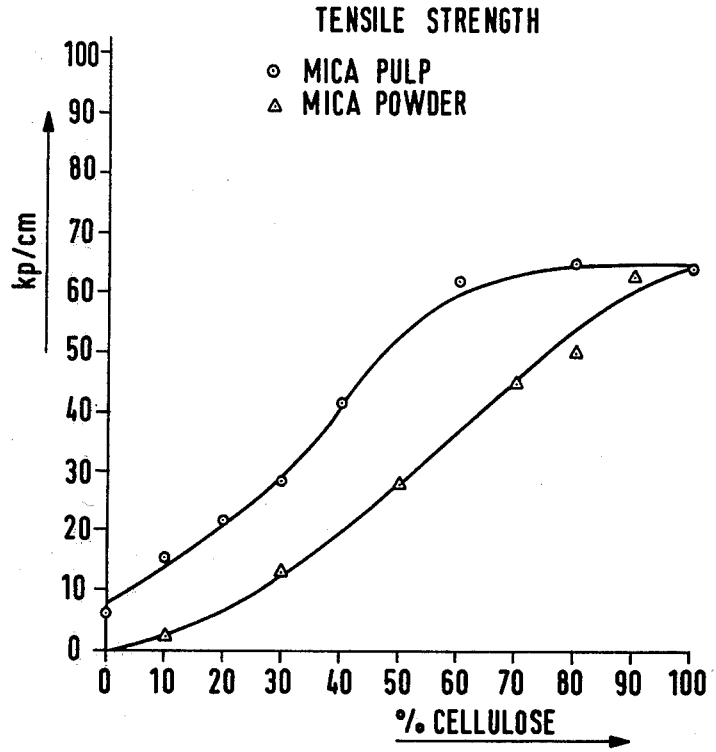

This application is a continuation-in-part of our copending application U.S. Ser. No. 652,781 filed Jan. 27, 1976, now abandoned.

The present application relates to an improved electrically insulating mica paper containing mica platelets and cellulose but no binder, and to a method of producing the same.

U.S. Pat. No. 322,034 discloses, among others, a paper for decorative purposes, particularly a decorating wall paper, having admixed therewith finely comminuted mica, which will give the paper a glistening appearance. The mica may be from about 5% to about 60% of the entire mass. The finely comminuted mica must have been a mica powder, although no specific examples are given. This paper is thus different from the mica paper of the invention with respect to the purpose which it serves, to the amount of mica and to the type of mica.

U.S. Pat. No. 1,868,566 relates to a process for manufacturing phenol-formaldehyde resin sheets or forms by adding 10 to 30% of mica, based on the weight of the fibre, to paper pulp (corresponding to 9 to 23% mica, based on the mixed pulp), forming the mixed pulp into sheets impregnating the sheets with phenol-formaldehyde resin varnish and subjecting the impregnated sheets to heat and pressure in order to render the resin infusible and insoluble. The mica is finely divided (mica powder) or even in the form of a colloidal paste. In this way, a dense product having a high resistance to water absorption is obtained. This product is, among others, different from the mica paper of the invention with respect to the amount and type of the mica used and to the presence of a cured binding agent.

U.S. Pat. No. 2,614,055 corresponds to Swiss Pat. Nos. 274,605 and 280,071 mentioned below and relates to a method of treating mica, wherein the particle size of mica is reduced not by grinding but by treating in such a way that the mica is essentially delaminated, i.e. split into platelets along the cleavage planes. It is only these platelets which can be used for making mica paper. Ground mica cannot be processed into paper because there is insufficient contact between individual mica particles.

U.S. Pat. No. 2,842,183 teaches an alleged improvement in the tensile strength of mica paper over the following U.S. Patents: U.S. Pat. No. 2,549,880 (which corresponds to French Pat. No. 982,402 mentioned below), U.S. Pat. No. 2,614,055 (mentioned supra), and U.S. Pat. No. 2,709,158 (which corresponds to French Pat. No. 1,005,600 mentioned below). This improvement is said to be achieved by contacting the comminuted mica particles with an aqueous barium sulphate solution. Experiments have, however, shown that the tensile strength of the resulting mica paper is considerably worse rather than better than that of untreated mica paper.

In these experiments, Example 2 of U.S. Pat. No. 2,842,183 was repeated using mica platelets produced as described in Example 1. Papers having a weight per unit area of 60 g/m$^2$ and 120 g/m$^2$ were produced. The resulting tensile strength may be seen from Table I.

Table I

| Tensile strength (kp/cm) of pure mica paper treated with barium chloride | | | | |
|---|---|---|---|---|
| Weight per unit area of paper | Treated with $BaCl_2$ | Thickness of paper (mm) | Untreated | Thickness of paper (mm) |
| 60 g/m$^2$ | 0.15 | 0.065 | 0.25 | 0.060 |
| 120 g/m$^2$ | 0.47 | 0.110 | 0.63 | 0.105 |

The experiment was repeated with equal amounts of barium acetate. The resulting tensile strengths may be seen from Table II.

TABLE II

| Tensile strength (kp/cm) of pure mica paper treated with barium acetate | | | | |
|---|---|---|---|---|
| Weight per unit area of paper | Treated with $Ba(OAc)_2$ | Thickness of paper (mm) | Untreated | Thickness of paper (mm) |
| 60 g/m$^2$ | 0.19 | 0.061 | 0.33 | 0.061 |
| 120 g/m$^2$ | 0.49 | 0.103 | 0.65 | 0.108 |

It was not at all obvious that by substituting the mica of U.S. Pat. No. 2,614,055 for the mica of U.S. Pat. No. 322,034 and changing the amounts of mica or by substituting the mica of U.S. Pat. No. 2,614,055 for the mica of U.S. Pat. No. 1,868,566, changing the amounts of mica and omitting the treatment with a binding agent and the curing treatment, a mica paper could be obtained which shows (as will be explained below) a synergistic action of the mica platelets and cellulose and serving a purpose different from that of U.S. Pat. No. 322,034.

Japanese Pat. No. 46-2762 relates to an electrically insulating paper produced from pulp made by mixing unbleached kraft pulp beaten to a freeness of between 25 and 50 on the Schopper-Riegler scale and between 10 and 50% by weight of kraft pulp beaten to a freeness between 80 and 97 on the Schopper-Riegler scale.

Although cellulosic pulp having a freeness like that of the pulp preferred for use in manufacturing the mica paper of the invention is known, nothing in the above-mentioned Japanese Patent suggests that by using such cellulosic pulp in amounts of 10 to 50% by weight in combination with mica platelets the breakdown voltage, tensile strength and porosity of the resulting mica paper could be greatly improved.

U.S. Pat. No. 3,001,571 relates to synthetic mica flakes, i.e. to extremely thin platelets of synthetic mica, which may be mixed with cellulose fibres and formed into sheet material which possesses good wet strength and improved handling characteristics. The platelets of synthetic mica have a thickness in the range of about 10 to 100 Ångström units (0.001 to 0.01 microns) and a ratio of average diameter to thickness in excess of 100:1. Contrary thereto, the natural mica platelets useful in the mica paper of the invention have diameters of 0.025 to 1.0 mm and a thickness from 1,000–30,000 Ångström units. The sheets containing mica and cellulose and disclosed in U.S. Pat. No. 3,001,571 are different from the mica paper of the invention with respect to the type and size of the mica and to the required cellulose content, which is not given in said U.S. Patent.

Nothing in U.S. Pat. No. 3,001,571 suggests that by using platelets of natural mica having a different size instead of platelets of synthetic mica and 10 to 50% by weight of cellulose, a mica paper could be obtained which shows (as will be explained below) a synergistic action of the mica platelets and cellulose.

Conventional methods of preparing a pulp of fine natural mica flakes involve either the mechanical treatment of mica in the liquid phase, or partial dehydration by heating followed either by mechanical treatment or by chemical and mechanical treatment in an aqueous medium. By suction-filtering this pulp on a sieve a paper can be prepared. The most important patents for the mechanical treatment without dehydration are U.S. Pat. Nos. 2,405,576 and 2,659,412. Those for the second procedure, i.e. partial dehydration and mechanical comminution, are Swiss Pat. Nos. 274,605 and 280,071 and those for the last procedure, i.e. partial dehydration and chemical treatment followed by mechanical treatment, are French Pat. Nos. 982,402; 984,969; 1,004,775 and 1,005,600.

Industrial processes based on all three procedures have been developed for the manufacture of mica paper.

The mica papers produced in this way only contain mica without any added binding agent. The properties of the paper, such as tensile strength, permeability to air and impregnatability with lacquers, vary depending on the method of manufacture. In each case the tensile strength is not high enough for the paper to be used as such for electrical insulation purposes. The cut tapes for use in today's industrial devices must have a tensile strength of about 14 N/cm width, where 1 N(Newton)=1 m kg $s^{-2}$. In most cases the mica paper has therefore been combined with backings such as fabrics (particularly glass fabrics), sheet-like materials (e.g. polyester films) or non-woven fabrics so that the mica paper can cope with the mechanical stresses which arise (Swiss Pat. No. 272,688). The use of each of these backings requires an additional binding agent, however, in order to hold the two materials together.

The above backing materials represent a necessary evil, especially in the case of insulations in which a mica tape wound on an electrical conductor is to be impregnated by saturating with solvent-free resin. Since the resin has to predominantly penetrate perpendicularly to the layer of mica paper, plastic films or sheets represent an almost impenetrable barrier to the resin. Glass filaments can certainly be saturated but a pronounced layer structure is formed. The effects of this layer structure on the electrical properties are difficult to explain theoretically, and it constitutes an interface in thermal ageing involved in flexural strength measurements. Non-woven fabrics are the best backings in this respect, apart from their resistance to heat which is low both for the low-priced materials and for the films.

As already mentioned, the mica paper and backing must be held together with a binding agent. Choosing this binding agent is not easy, as it must be compatible with the impregnating agent applied later and must ensure sufficient adhesion even in very small amounts. In every case this binding agent has an unfavourable influence on the impregnatability of the tape and of the insulation made from the tape.

There has been no lack of attempts to reinforce the mica paper by adding binding agents or fibres as early as during the production of the mica paper. Specific binders are disclosed in:

French Pat. No. 964,359: colloidal silicic acid or hydrolysates of silicic acid esters, Swiss Pat. No. 272,687: phenolic resins, French Pat. Nos. 984,969 and 1,004,775: inorganic binding agents such as borates, and Swiss Pat. No. 274,605: melamine resins.

Common to all these processes is the production of a mica paper which is significantly more resistant mechanically. For certain applications for which the mica paper may be laminated under pressure to give a multilayer material, mica paper produced by the prior art methods works well since in such cases the binding agent already present or added subsequently only has to contribute to the adhesion of the individual layers to each other. With products such as spacers, plates of commutator micanite and micanite used in heaters even the presence of trapped air does not present any problems, but if complete impregnation of a wound insulation made of mica paper by a solvent-free resin is required, then the last-named types of mica paper cannot be used because the impregnating agent would only penetrate into the outer layers and no further. (Micanite is understood to consist of layers of mica splittings which have been adhered to each other by means of binders.)

Certain fibres have also been added to the mica paper, e.g. glass fibres (French Pat. No. 1,058,676). But the admixture of such fibres in slurry form to the mica always comes down in principle to the fact that the fibres lodge as foreign bodies or disturbing elements between the particles of mica. Thus although the porosity increases, the mechanical cohesion deteriorates so that it is impossible to process the resulting mica paper. Synthetic fibres behave no better in this respect than glass fibres. A beating process used in the cellulose paper industry does not give an improvement either since the only slightly hydrophilic fibres obviously have no affinity for the mica particles.

In the beating process used in the manufacture of papermaking fibre the cellulose fibres are swollen in water and split into molecular aggregates, so-called fimbriated micelles being formed. As they dry the micelles help to adhere the molecular aggregates by means of secondary valences so that a paper which is strong enough mechanically is produced without any special sizing. On account of the high temperatures to which the mica paper is exposed in use, it had always been considered impossible to add cellulose fibres to it.

The applicant has surprisingly found however that if cellulose fibres are suitably opened (i.e. separated into individual fibres by beating so that the desired freeness is obtained) they form a pulp which, when mixed with platelets of natural mica, gives a paper sheet strong enough to allow further processing, the breakdown voltage, permeability to air and impregnatability and the tensile strength of the mica paper reaching unexpectedly high levels. The tensile strength is even high enough for the winding procedure to be carried out without the use of a special backing. Mica paper in which the cellulose fibres are present in the range of 10 to 50% by weight, preferably 20 to 30% by weight, based on the total weight of the mica plus the cellulose, will have a tensile strength in excess of –N/cm tape width.

The following examples are illustrative of the invention without limiting it.

EXAMPLE 1

The following is an example of the method used to produce the paper of the invention. Mica platelets were produced without any chemical treatment, but simply by beating as follows: Natural mica scrap (muscovite from India) was fired at 850° C. for thirty minutes, added to water and disintegrated by vigorous stirring as described in Swiss Pat. No. 274,605. A mixture of water and softwood sulphate cellulose (freeness of 44 on the Schopper-Riegler scale) was prepared and the disintegrated mica added to form a slurry containing sulphate cellulose in about 30% by weight. This slurry was then fed to a conventional laboratory paper machine (fourdrinier type) to form a sheet. The final insulation sheet thus obtained had a weight per unit area of 120 g/square meter, a tensile strength of 33 Newton/cm and a penetration time (impregnatability) of 78 seconds (ASTM 202-73). Several papers using cellulose of other freeness and other proportions of cellulose and mica as described hereinafter, were produced by similar processing.

Tensile strength measurements can be made on a normal tension tester designed for this purpose and having a recording mechanism.

The porosity and the permeability to air may be determined with various kinds of apparatus. The values given below were obtained with a Bekk apparatus, made by A. van der Korput, Baarn, Holland. An electric, recording stop-clock was used to measure the time in seconds taken for 10 ml of air to be sucked through a 100 $mm^2$ area of the paper under examination by a partial vacuum of 0.49 bars. High values (in seconds) mean that the paper under investigation is not very porous. A suction time of only a few seconds is a good result.

The impregnatability was measured by Williams' method which is described in ASTM-Standard 202-73. The time measured was that taken by a test liquid to penetrate through the paper inserted in the apparatus. According to the standard the test liquid is castor oil, but other liquids may be used should they prove more suitable. In the present case a mixture of 60 parts by volume of castor oil and 40 parts by volume of toluene was chosen (density=0.917). As with the above method for determining the porosity, the time in seconds taken for the area in contact with the liquid to become completely translucent, i.e. completely saturated with the test liquid, is measured with a stop-clock. In this case too, a low value means good impregnatability.

A series of experiments was carried out to examine the effect of the freeness on the properties of the mica paper obtained from mica pulp containing 25% by weight of a softwood sulphate cellulose or softwood sulphite cellulose. The mica papers all had a weight per unit area of 120 $g/m^2$. The freeness was determined by the Schopper-Riegler method.

| | Freeness (Schopper-Riegler) | Porosity (Bekk) | Impregnatability (Williams) | Tensile Strength (N/cm) |
|---|---|---|---|---|
| Sulphate Cellulose | 9 | 0.5 | 14 | 5 |
| | 13 | 1 | 22 | 8 |
| | 15 | 5 | 52 | 24 |
| | 26 | 6 | 50 | 30 |
| | 44 | 12 | 78 | 33 |
| | 62 | 19 | 120 | 34 |
| | 75 | 24 | 152 | 33 |
| Sulphite Cellulose | 8 | 1 | 18 | 6 |
| | 14 | 2 | 23 | 8 |
| | 20 | 5 | 29 | 19 |
| | 40 | 10 | 44 | 21 |
| | 60 | 13 | 69 | 27 |
| Comparison: paper of same thickness made from mica pulp only | — | 30 | 93 | 7 |

It can be seen from these figures that the properties of the mixed paper obtained by adding cellulose with a freeness within a particular range are significantly improved. The tensile strength is increased and the porosity and impregnatability improved at the same time.

It appears that the properties of the paper are best when the freeness is from 20 to 60 on the Schopper-Riegler scale. At higher freeness values the porosity reaches values equal to those of pure mica paper. More expensive cotton linters or other cellulose fibres used industrially can also be employed to give similar properties.

There is no point in raising the cellulose fibre content of mica paper used for electrical insulation above the value necessary for the mechanical properties. Insulation is in fact required which contains more than 50% of mica. Since the cellulosic mica paper when used for insulating purposes is in addition impregnated with a resin, an insulation made of mica paper containing 50% by weight of cellulose and 50% by weight of mica would after impregnation contain more than 50% by weight of total organic material (cellulose+resin). A proportion of cellulose less than 50% by weight is therefore desirable. The proportion of cellulose fibres best for easily impregnatable tapes is 20 to 30% by weight.

Thus it has now become possible, by adding 20 to 30% by weight of cellulose fibres of a suitable freeness, to improve the tensile strength and at the same time the porosity and impregnatability of mica paper relative to the properties of pure mica paper of the same weight per unit area.

EXAMPLE 2

Platelets of natural mica were produced as described in Example 1. A mixture of water and softwood sulphate cellulose (freeness of 44 on the Schopper-Riegler scale) was prepared and the disintegrated mica added to form slurries containing sulphate cellulose in amounts varying from 10 to 90% by weight. Similar slurries containing 100% by weight of mica and 100% by weight of sulphate cellulose, respectively, were likewise produced. Sheets were formed from the slurries described in Example 1.

Figure 2:
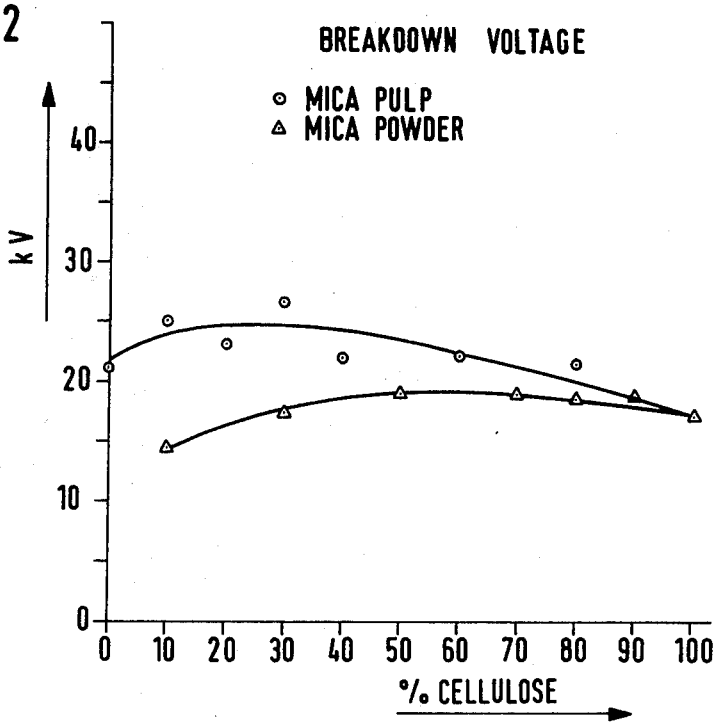
Figure 3:
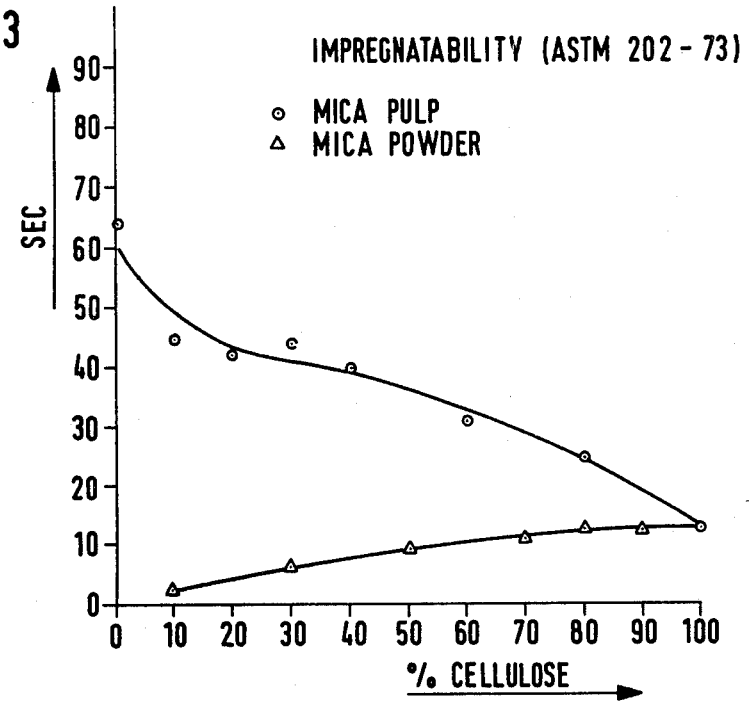
Figure 4:
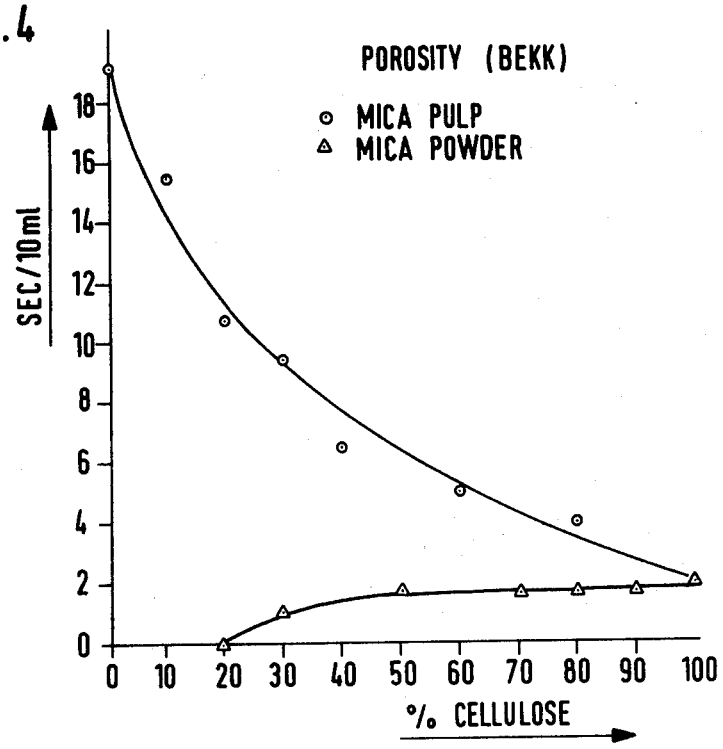

The impregnatability according to ASTM-Standard 202-73, the porosity according to Bekk and the tensile strength of the sheets were determined as described in Example 1. The results are shown in FIGS. 1, 3 and 4 of the accompanying drawing, where the tensile strength is given in kp per cm width (1 kp=9.8 N). In FIG. 2, the breakdown voltage of the sheets in kV is plotted against the cellulose content in % by weight.

For comparison, similar slurries were prepared using a commercially available mica powder (mica powder wet ground 200 to 250 mesh, produced by L. H. Torkildsen, Bones, Belgium). These slurries were likewise formed into sheets as described in Example 1, and the impregnatability according to ASTM-Standard 202-73, the porosity according to Bekk, the tensile strength and the breakdown voltage of the sheets determined. The results are likewise shown in FIGS. 1 to 4 of the drawing.

FIGS. 3 and 4 of the drawing show that the porosity of the mica paper of the invention containing 10 to 50% by weight of mica platelets (the curves designated "mica pulp") is higher than what could be expected from the properties of the pure mica platelets and those of the pure cellulose, i.e. that there is a synergistic effect.

FIG. 1 shows, that the tensile strength of the mica paper of the invention containing 10 to 50% by weight of mica platelets (the curve designated "mica pulp") is likewise higher than what could be expected from the additive effect of the properties of the pure mica platelets and those of the pure cellulose, i.e. that there is a synergistic effect.

In addition, the tensile strength of the mica papers of the invention is surprisingly much higher than that of mica papers containing the same amount of commercial mica powder. Only mica powder slurries containing at least about 10% by weight of cellulose form a sheet useful for measurement of their properties. From 10 to 100% by weight of cellulose, the tensile strength of a sheet containing commercial mica powder increases in a nearly linear manner. On the other hand, the tensile strength of mica papers containing mica platelets approximates a maximum value at 60% by weight of cellulose, which remains substantially the same up to 100% by weight of cellulose.

FIG. 2 of the drawing shows that the breakdown voltage of the mica paper of the invention containing 10 to 50% by weight of mica platelets (the curve designated "mica pulp") is also higher than what could be expected from the additive effect of the properties of the pure mica platelets and those of the pure cellulose, i.e. that a synergistic effect is obtained.

Moreover, the breakdown voltage of the mica papers of the invention is surprisingly much higher than that of mica papers containing the same amount of commercial mica powder. The pure mica platelets have a breakdown value which is not at all reached with papers containing commercial mica powder.

If cellulose of other types, such as kraft cellulose, newspaper cellulose, rag cellulose or alphacellulose, is employed in the mica papers of the invention, similar results are obtained.

What we claim is:

1. An electrically insulating mica paper containing cellulose, but no binding agent and having a tensile strength and a porosity higher than those of pure mica paper, the tensile strength being sufficiently high for the mica paper to be processed without a backing, characterized in that the mica paper contains (i) at least about 50% by weight of platelets of natural mica produced without using chemicals other than water, said mica platelets having diameters in the range of 0.025 to 1 mm and a thickness in the range of 1,000–30,000 Ångström units and (ii) about 10 to 50% by weight of cellulose fibres, said mica paper has an impregnatability according to ASTM 202-73 in the range of about 35 to 50 seconds, and a porosity according to Bekk in the range of about 6 to 15 seconds per 10 milliliters.

2. The mica paper of claim 1, characterized in that the mica paper contains 20 to 30% by weight of cellulose fibres, has an impregnatability according to ASTM 202-73 in the range of about 41 to 45 seconds, and a porosity according to Bekk in the range of about 9 to 12 seconds per 10 milliliters.

3. The mica paper of claim 1, characterized in that the cellulose fibres have a freeness of 20 to 60 on the Schopper-Riegler scale.

4. The mica paper of claim 2, characterized in that the cellulose fibres have a freeness of 20 to 60 on the Schopper-Riegler scale.

* * * * *